United States Patent [19]

Elter

[11] Patent Number: 4,588,281

[45] Date of Patent: May 13, 1986

[54] FUSING APPARATUS

[75] Inventor: Michael R. Elter, Webster, N.Y.

[73] Assignee: Xerox Corporation, Stamford, Conn.

[21] Appl. No.: 647,005

[22] Filed: Sep. 4, 1984

[51] Int. Cl.[4] ..... G03G 15/20

[52] U.S. Cl. ..... 355/3 FU; 219/216; 432/60

[58] Field of Search ..... 355/3 FU; 219/216, 388, 219/553; 432/60

[56] References Cited

U.S. PATENT DOCUMENTS 3,331,592 7/1967 Cassano et al. ..... 263/6
4,009,953 3/1977 Ravizza et al. ..... 355/3 FU

FOREIGN PATENT DOCUMENTS 119160 9/1981 Japan ..... 355/3 FU
53773 3/1982 Japan ..... 355/3 FU

*Primary Examiner*—R. L. Moses
*Attorney, Agent, or Firm*—H. Fleischer; J. E. Beck; R. Zibelli

[57] ABSTRACT

An apparatus in which an image on a sheet of support material is fused thereto. A fuser roller is arranged to contact the sheet of support material having the image to be fused thereon. The fuser roller has a heating element disposed internally and extending substantially along the longitudinal axis thereof. The heating element is asymmetrical with respect to a reference axis extending through the center of the fuser roller and normal to the longitudinal axis thereof.

10 Claims, 5 Drawing Figures

FUSING APPARATUS

This invention relates generally to a fusing device used in an electrophotographic printing machine, and more particularly concerns a fuser roller employed therein for insuring a substantially uniform temperature profile across a sheet of support material having an image fused thereto.

Generally, an electrophotographic printing machine employs a photoconductive member which is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After recording the electrostatic latent image on the photoconductive member, it is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, the fusing device employs a heated fuser roller to heat the toner particles and permanently affix them to the copy sheet. However, it has been found that when a heated, oil wetted, fuser roller is employed, temperature ingredients develop in the longitudinal direction on the surface of the fuser roller due both to the nature of internally heated cylinder and the variation of the coefficient of heat transfer in the nip through which the copy sheet passes. Hereinbefore, the heating lamp filament extended from one end of the fuser roller to the other end thereof. The length of the roller had to be sufficient to extend across the largest size copy sheet passing therethrough. Thus, if the printing machine were reproducing copies on 11 inch and 14 inch copy paper, the length of the fuser roller had to be at least 14 inches. Under these circumstances, it has been found that a thermal hump occurred in the vicinity of the edge of the 11 inch dimension. Thus, when an 11 inch copy sheet passed through the fuser, the temperature, in the vicinity of the 11 inch edge, increased approximately 25° F. This temperature jump represents a high thermal stress at the 11 inch edge which may cause hot offsetting of the toner particles. A second instance of toner particle offsetting may occur if, after the completion of a copy run employing 11 inch paper, 14 inch paper is run through the fusing device. At the completion of the 11 inch copy run, the surface temperature of the fuser roller increases rapidly. Since this increase is occurring along the entire length of the fuser roller, the thermal hump at the 11 inch edge also increases so that if a 14 inch sheet of copy paper subsequently passes through the fuser, even larger thermal stresses occur. Thus, it is highly desirable to decrease the thermal hump at the 11 inch edge. Various approaches have been devised to heat the fuser roller, the following disclosure appears to be relevant:

U.S. Pat. No.: 3,331,592 Patentee: Cassano et al. Issued: July 18, 1967

The pertinent portions of the foregoing disclosure may be briefly summarized as follows:

Cassano et al. discloses a fuser roller having a resistance heating element disposed interiorly thereof. The heating element extends along the longitudinal axis of the roll. The ends of the resistance heating elements project through the shanks of the roll.

In accordance with one aspect of the features of the present invention, there is provided an apparatus for fusing images onto a sheet of support material. A fuser roller is arranged to contact the sheet of support material having the image to be fused thereon. A heating element, disposed internally of the fuser roller and extending substantially along the longitudinal axis thereof, is asymmetrical with respect to a reference axis extending through the center of the fuser roller and normal to the longitudinal axis thereof.

Pursuant to another aspect of the features of the present invention, there is provided an electrophotographic printing machine of the type having a fusing apparatus for fusing the toner powder image transferred to a copy sheet during a copy run of the printing machine. The improved fusing apparatus includes a fuser roller arranged to contact the sheet of support material having the image to be fused thereon. A heating element is disposed internally of the fuser roller and extends substantially along the longitudinal axis thereof. The heating element is asymmetrical with respect to a reference axis extending through the center of the fuser roller and normal to the longitudinal axis thereof.

Other aspects of the invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents that may be included within the spirit and scope of the invention as defined by the appended claims.

Figure 1:
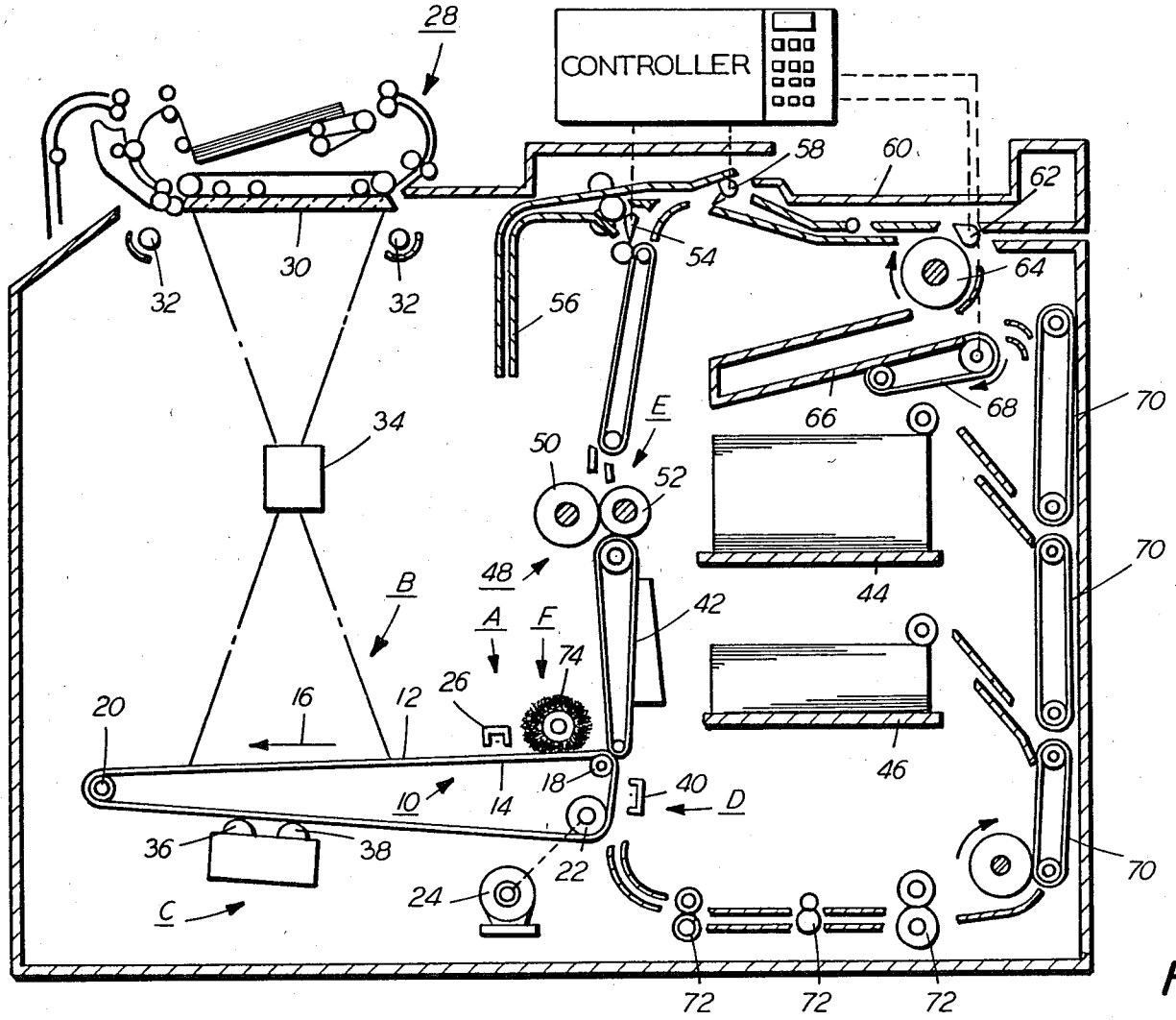
FIG. 1 is an elevational view illustrating an exemplary electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various componts of an illustrative electrophotographic printing machine incorporating the fusing apparatus of the present invention therein. It will become evident from the following discussion that the fusing apparatus of the present invention is equally well suited for use in a wide variety of electrostatographic printing machines and is not necessarily limited in its application to the particular printing machine shown herein.

Inasmuch as the art of electrophotographic printing is well known, the various processing stations employed in the FIG. 1 printing machine will be shown hereinafter schematically and their operation discribed briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed.

Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Stripping roller 18 is mounted rotatably so as to rotate with the movement of belt 10. Tensioning roller 20 is resiliently urged against belt 10 to maintain belt 10 under the desired tension. Drive roller 22 is rotated by motor 24 coupled thereto by a suitable means such as a drive belt. As drive roller 22 rotates, belt 10 advances in the direction of arrow 16.

Initially, a portion of photoconductive surface 12 passes through charging station A. At charging station A, a corona generating device, indicated generally by the reference numeral 26, charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feeds documents from a stack of documents placed by the operator face up in a normal forward collating order in a document stacking and holding tray. A document feeder, located below the tray, forwards the bottom document of the stack to a pair of take away rollers. The bottommost sheet is then sent, by rollers, through a document guide to a feed roll and conveyor belt. The conveyor belt advances the document onto platen 30. After imaging, the original document is fed from platen 30 by the conveyor belt onto a guide and feed roll pairs which advance the document into an inverter mechanism, or back to the document stack through feed roll pairs. A decision gate is provided to divert the document either to the inverter or to the feed roll pairs. Imaging of a document on platen 30 is achieved by lamps 32 which illuminate the document positioned thereon. Light rays reflected from the document are transmitted through lens 34. Lens 34 focuses the light image of the original document onto the charged portion of photoconductive surface 12 to selectively dissipate the charge thereon. This records an electrostatic latent image on photoconductive surface 12 which corresponds to the informational areas contained within the original document. Thereafter, belt 10 advances the electrostatic latent image recorded on photoconductive surface 12 to development station C.

With continued reference to FIG. 1, at development station C, a pair of magnetic brush developer rollers, indicated generally by the reference numerals 36 and 38, advance developer material into contact with the electrostatic latent image. The latent image attracts toner particles from the carrier granules of the developer material to form a toner power image on photoconductive surface 12 of belt 10.

Belt 10 then advances the toner powder image to transfer station D. At transfer station D, a copy sheet is moved into contact with the toner powder image. Transfer station D includes a corona generating device 40 which sprays ions onto the backside of the copy sheet. This attracts the toner powder image from photoconductive surface 12 of belt 10 to the sheet. After transfer, conveyor 42 advances the copy sheet to fusing station E.

The copy sheets, selected from either tray 44 or 46, are advanced to transfer station D by conveyor belts 70 and feed rollers 72. After transfer of the toner powder image to the first side of the copy sheet, the sheet is advanced by conveyor 42 to fusing station E.

Fusing station E includes a fusing apparatus, indicated generally by the reference numeral 48. Preferably, the fusing apparatus includes a heated fuser roller 50 and a back-up roller 52 with the toner powder image on the sheet contacting fuser roller 50. In this manner, the powder image is permanently affixed to the copy sheet. The detailed structure of fusing apparatus 48 will be described hereinafter with reference to FIG. 2.

After fusing, the copy sheets are fed to decision gate 54 which functions as an inverter selector. Depending upon the position of gate 54, the sheets will be deflected into sheet inverter 56 or bypass sheet inverter 56 and be fed directly to a second decision gate 58. The sheets which bypass inverter 56 turn a 90° corner in the sheet path before reaching gate 58. This inverts the sheets into a face up orientation so that the image side, which has been transferred and fused, is face up. If the path to sheet inverter 56 is selected, the opposite is true, i.e. the last printed side is face down. The second decision gate 58 either deflects the sheet directly into output tray 60 or deflects the sheets into a transport path which carries them on without inversion to a third decision gate 62. Gate 62 either passes the sheets directly on without inversion into the output path of the copier or deflects the sheet onto a duplex inverter roller 64. Roller 64 inverts and stacks the sheets to be duplexed in duplex tray 66 when gate 62 so directs. Duplex tray 66 provides intermediate buffer storage for those elements which have been printed on one side and on which an image will be subsequently printed on the side opposed thereto, i.e. the sheets being duplexed. Due to the sheets being inverted by roller 64, the sheets are stacked in tray 66 face down. The sheets are stacked in duplex tray 66, on top of one another in the order in which they are copied.

In order to complete duplex copying, the simplex sheets in duplex tray 66 are fed in series by bottom feeder 68 from tray 66 back to transfer station D for transfer of the toner powder image to be opposed side of the copy sheet. Conveyors 70 and rollers 72 advance the sheet along the path which produces an inversion thereof. However, inasmuch as the bottommost sheet is fed from duplex tray 66, the proper or clean side of the copy sheet is in contact with belt 10 at transfer station D so that the toner powder image on photoconductive surface 12 is transferred thereto. The duplex sheets are then fed through the same path as the simplex sheets to be stacked in tray 60 for subsequent removal by the machine operator.

Invariably, after the copy sheet is separated from photoconductive surface 12 of belt 10 some residual particles remain adhering thereto. These residual particles are removed from photoconductive surface 12 at cleaning station F. Cleaning station F includes a rotatably mounted fiberous brush 74 in contact with photoconductive surface 12 of belt 10. These particles are cleaned from photoconductive surface 12 of belt 10 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

Controller 76 is preferably a programmable microprocessor which controls all the machine functions. The controller provides the storage and comparison of counts of the copy sheets, the number of documents being recirculated in the document sets, the number of copy sheets selected by the operator, time delays, jam correction control, fuser temperature control, etc. The control of all of the systems in the printing machine may be accomplished by conventional control switch inputs from the printing machine console selected by the operator. Conventional sheet path sensors or switches may be employed for tracking or keeping track of the position of the documents and copy sheets. Controller 76 contains the necessary logic for regulating the temperature of fuser 48.

It is believed that the foregoing description is sufficient for purposes of the present invention to illustrate the general operation of an electrophotographic printing machine incorporating the features of the present invention therein. Referring now to the specific subject matter of the present invention, fuser 48 will be described with reference to FIG. 2.

Figure 2:
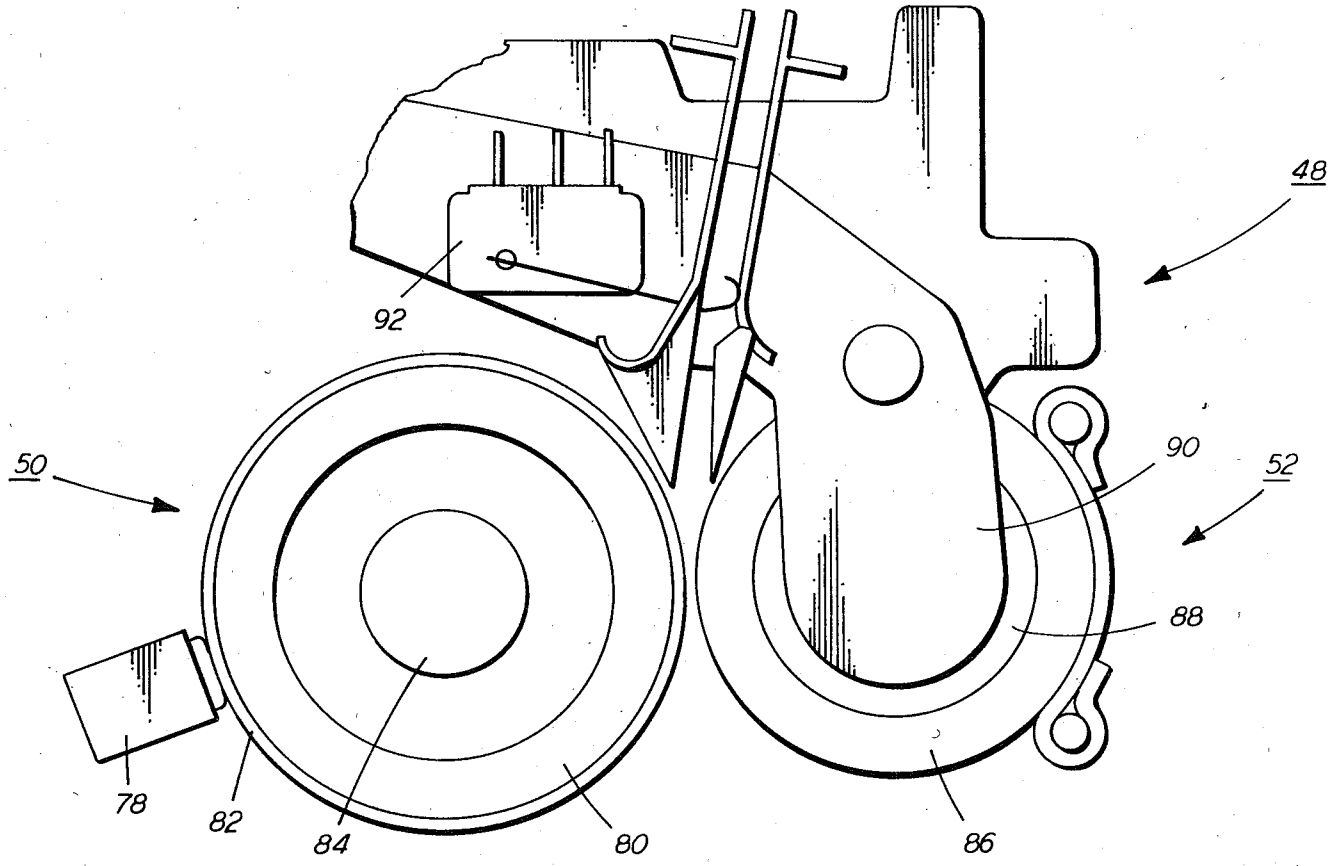
FIG. 2 is a fragmentary, elevational view depicting the fusing apparatus used in the FIG. 1 printing machine.

As shown in FIG. 2, fuser 48 includes a fuser roller, indicated generally by the reference numeral 50, and a back-up roller, indicated generally by the reference numeral 52. Temperature sensor 78 contacts the exterior circumferential surface of fuser roller 50. By way of example, temperature sensor 78 may be a thermostat whose resistance varies as a function of the detected temperature. Fuser roller 50 is composed of a hollow tube 80 having a thin covering 82 thereon. A heating element 84 is disposed interiorly of tube 80. A thin layer of silicone oil is metered onto the fuser roller during fusing. Tube 80 is made from a metal material having the desired heat conductivity characteristics. By way of example, aluminum, copper and other metals having a high thermal conductivity are suitable for use as a tube. Preferably, layer 82 coating tube 80, is made from silicone rubber. The detailed structure of heating element 84 will be described hereinafter with reference to FIG. 3. However, heating element 84 is connected to sensor 78 through controller 76. Back-up roller 52 has a relatively thick layer of silicone rubber 86 on metal tube 88. Back-up roller 52 is mounted rotatably on bracket 90. Bracket 90 is actuated by controller 76 to pivot so as to press back-up roller 52 into contact with fuser roller 50 to define a nip therebetween through which the copy sheet passes. Switch 92 detects the presence or absence of the copy sheet in fusing apparatus 48 and indicates the status thereof to controller 76. Rollers 50 and 52 remain spaced from each other whenever fusing is not occurring. When fusing is occurring, roller 52 pivots so as to press against fuser roller 50. Back-up roller 52 and fuser roller 50 are adapted to rotate during the fusing operation so as to advance the copy sheet therethrough. The detailed structure of fuser roller 50 will be described hereinafter with reference to FIG. 3.

Figure 3:
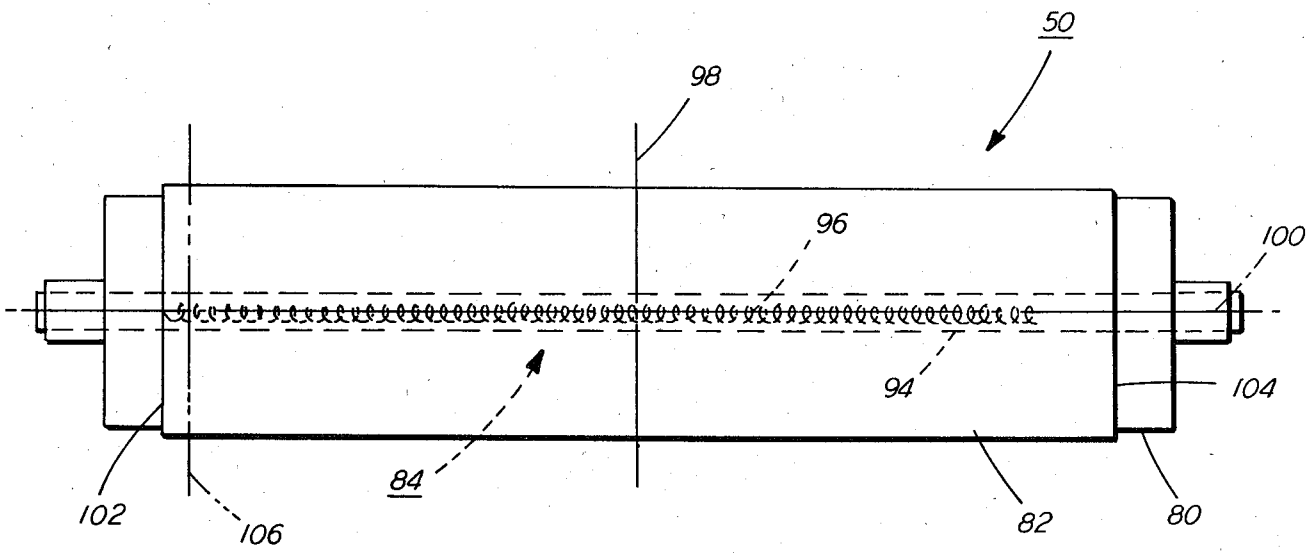
FIG. 3 is an elevational view showing the fuser roller used in the FIG. 2 fusing apparatus.

Turning now to FIG. 3, fuser roller 50 includes a heating element, indicated generally by the reference numeral 84. Heating element 84 comprises a fuser lamp 94 having a filament 96 disposed interiorly thereof. As shown, fuser lamp 94 extends substantially along the longitudinal axis of fuser roller 50. Similarly, lamp filament 96 extends along the longitudinal axis of fuser roller 50 disposed interiorly of fuser lamp 94. As shown, lamp filament 96, which is the heating element of fuser lamp 94, is asymmetrical with respect to a reference axis extending through the center of fuser roller 50 in a direction substantially normal to longitudinal axis 100. The ends of fuser roller 50 are defined by the ends of coating 82. Thus, fuser roller 50 extends from end 102 to end 104. Lamp filament 96 extends in a longitudinal direction, substantially along longitudinal axis 100 of fuser roller 50 from end 102 to a preselected position intermediate axis 98 and end 104. All copy sheets passing through fusing apparatus 50 are registered or aligned such that one edge thereof is substantially aligned with reference mark 106 on fuser roller 50. Reference mark 106 is located intermediate end 102 and reference axis 98. Lamp filament 96 extends from end 102 to a preselected location intermediate reference axis 98 and end 104 of fuser roller 50. The distance between registration mark 106 and the end of lamp filament 96 corresponds to the size of the largest copy sheet passing through fusing apparatus 48. Thus, if the largest size copy sheet passing through fusing apparatus 48 were 14 inches, lamp filament 96 would extend a distance of 14 inches from registration mark 106. Preferably, registration mark 106 is 0.295 inches from end 102 of fuser roller 50. By way of example, heating element 84 may be a halogen lamp having an assymetric lamp filament.

Figure 4:
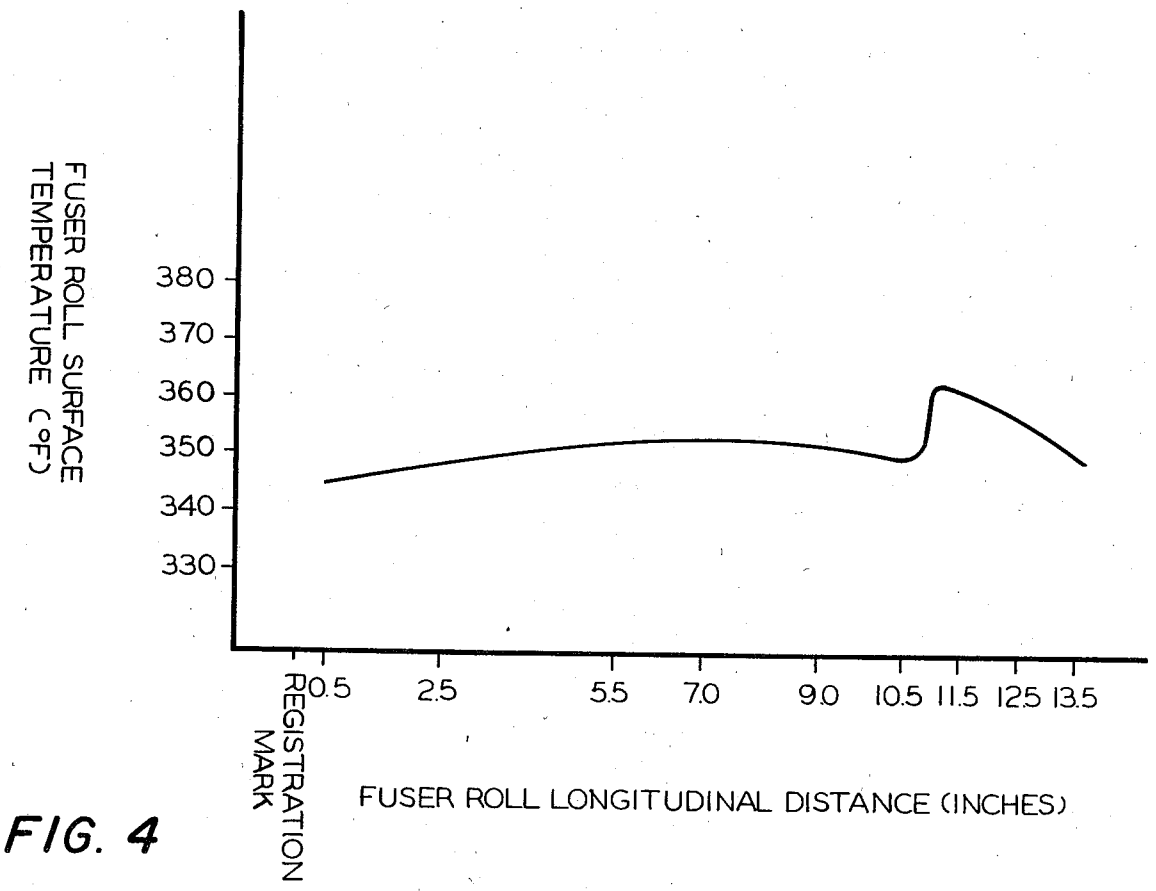
FIG. 4 is a graph showing the temperature variation of the fuser roller for an 11 inch sheet of copy paper.

Turning now to FIG. 4, there is shown a temperature profile of the fuser roller surface temperature when an 11 inch sheet of copy paper passes through fusing apparatus 48. As shown, the temperature profile remains substantially constant between 340° F. and 350° F. from one end of the fuser roller for a distance of approximately 11 inches. At the 11 inch point, there is a temperature rise of approximately 12° from about 348° F. to about 360° F. It is clear that by foreshortening the lamp filament, the thermal hump has been significantly reduced, i.e. by about 50%.

Figure 5:
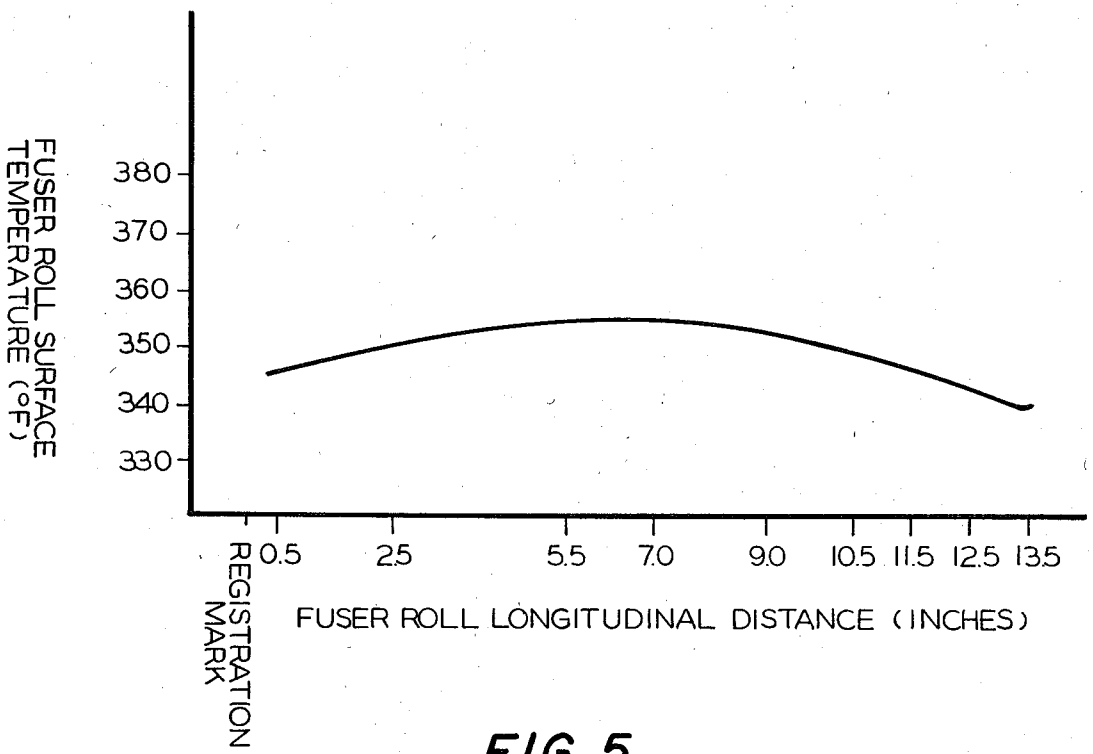
FIG. 5 is a graph showing the temperature variation for a 14 inch sheet of copy paper.

Referring now to FIG. 5, there is shown the change in fuser roll temperature along its length when a 14 inch sheet of copied paper passes through fusing apparatus 48. As shown, no thermal hump is produced and the temperature profile remains substantially constant increasing from the ends thereof to the midpoint by about 10° F. By selecting the optimum length of the lamp filament, the thermal hump is reduced without decreasing the temperature of the copy sheet such that the toner powder image is inadequately fused.

In recapitulation, it is evident that the fusing apparatus of the present invention reduces the thermal hump produced when 11 inch copy paper is employed during the fusing operation. This is achieved by utilizing a heating element which is asymmetrical with respect to a reference axis normal to the longitudinal axis of the fuser roller and passing through the center thereof. This type of fusing apparatus produces excellent, high quality fused images on copy sheets of various sizes.

It is, therefore, evident that there has been provided in accordance with the present invention, a fusing apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

I claim:

1. An apparatus for fusing images onto a sheet of support material, including:

a fuser roll arranged to contact the sheet of support material having the image to be fused thereon; and a heating element disposed internally of said fuser roll and extending substantially along the longitudinal axis thereof from one end of said fuser roll to a preselected position intermediate a reference axis extending through the center of said fuser roll and normal to the longitudinal axis thereof and the other end of said fuser roll with the region between the preselected position and the other end of said fuser roll not having a heating element disposed thereat.

2. An apparatus according to claim 1, wherein said heating element includes:

a heating lamp extending from at least said one end of said fuser roll to at least said other end thereof; and a heating filament disposed internally of said heating lamp and extending from said one end of said fuser roll to said preselected position.

3. An apparatus for fusing images onto a sheet of support material, including:

a fuser roll arranged to contact the sheet of support material having the image to be fused thereon; and a heating element disposed internally of said fuser roll and extending substantially along the longitudinal axis thereof, said heating element being asymmetrical with respect to a reference axis extending through the center of said fuser roll and normal to the longitudinal axis thereof, said heating element extending from one end of said fuser roll substantially along the longitudinal axis of said fuser roll to a preselected position intermediate the reference axis and other end of said fuser roll, said heating element including a heating lamp extending from at least said one end of said fuser roll to at least said other end thereof, and a heating filament disposed internally of said heating lamp and extending from said one end of said fuser roll to said preselected position wherein one edge of the sheet of support material is aligned with a registration mark on said fuser roll with the registration mark being closely adjacent to said one end of said fuser roll.

4. An apparatus according to claim 3, wherein said heating filament extends from at least said registration mark to said preselected position a distance substantially equal to the size of the largest sheet of support material having an image fused thereon.

5. An apparatus according to claim 4, further including a back-up roll engaging said fuser roll to define a nip through which the sheet of support material with the image thereon passes.

6. An electrophotographic printing machine of the type having a fusing apparatus for fusing a toner powder image transferred to a copy sheet during a copy run of the printing machine, wherein the improved fusing apparatus includes:

a fuser roll arranged to contact the copy sheet having the image to be fused thereon; and a heating element disposed internally of said fuser roll and extending substantially along the longitudinal axis thereof from one end of said fuser roll to a preselected position intermediate a reference axis extending through the center of said fuser roll and normal to the longitudinal axis thereof and the other end of said fuser roll with the region between the preselected position and the other end of said fuser roll not having a heating element disposed thereat.

7. A printing machine according to claim 6, wherein said heating element includes:

a heating lamp extending from at least said one end of said fuser roll to at least said other end thereof; and a heating filament disposed internally of said heating lamp and extending from said one end of said fuser roll to said preselected position.

8. An electrophotographic printing machine of the type having a fusing apparatus for fusing a toner powder image transferred to a copy sheet during a copy run of the printing machine, wherein the improved fusing apparatus includes:

a fuser roll arranged to contact the copy sheet having the image to be fused thereon; and a heating element disposed internally of said fuser roll ad extending substantially along the longitudinal axis thereof, said heating element being asymmetrical with respect to a reference axis extending through the center of said fuser roll and normal to the longitudinal axis thereof, said heating element extending from one end of said fuser roll substantially along the longitudinal axis of said fuser roll to a preselected position intermediate the reference axis and other end of said fuser roll, said heating element including a heating lamp extending from at least said one end of said fuser roll to at least said other end thereof, and a heating filament disposed internally of said heating lamp and extending from said one end of said fuser roll to said preselected position wherein one edge of the copy sheet is aligned with a registration mark on said fuser roll with the registration mark being closely adjacent to said one end of said fuser roll.

9. A printing machine according to claim 8, wherein said heating filament extends from at least said registration mark to said preselected position a distance substantially equal to the size of the largest copy sheet having a toner powder image fused thereto.

10. A printing machine according to claim 9, further including a back-up roll engaging said fuser roll to define a nip through which the copy sheet with the toner powder image thereon passes.

* * * * *